United States Patent [19]

Remington

[11] 4,114,235

[45] Sep. 19, 1978

[54] STAY FOR HINGED MEMBERS

[75] Inventor: Richard Charles Remington, Pompton Plains, N.J.

[73] Assignee: Presto Lock Company, Division of Walter Kidde & Company, Inc., Garfield, N.J.

[21] Appl. No.: 806,482

[22] Filed: Jun. 14, 1977

[51] Int. Cl.[2] ..... E05D 11/10

[52] U.S. Cl. ..... 16/139; 16/146; 217/60 E

[58] Field of Search ..... 16/139, 145, 146; 248/477, 478; 292/263, 204, 103, 109, 209; 403/93, 94, 98, 95; 217/60 E

[56] References Cited

U.S. PATENT DOCUMENTS

| | | | |
|---|---|---|---|
| 1,693,169 | 11/1928 | Young | 16/139 |
| 1,779,281 | 10/1930 | Levine | 217/60 E |
| 1,827,595 | 10/1931 | MacGuire | 292/263 |
| 2,442,955 | 6/1948 | Lundberg | 292/263 X |
| 3,141,694 | 7/1964 | Birmingham | 16/139 |
| 3,285,647 | 11/1966 | Birmingham et al. | 292/263 |
| 3,359,029 | 12/1967 | Fernberg | 16/146 |
| 3,740,791 | 6/1973 | Bulin | 292/263 X |

FOREIGN PATENT DOCUMENTS

| | | | |
|---|---|---|---|
| 355,556 | 8/1931 | United Kingdom | 292/263 |

*Primary Examiner*—Ronald Feldbaum
*Attorney, Agent, or Firm*—Shapiro and Shapiro

[57] ABSTRACT

A stay, which may be used to retain the open position of the cover of a suitcase, for example, comprises a pair of arms which turn relatively about a pivot pin extending through overlapped ends of the arms. The pivot pin holds a spring plate superposed with the overlapped ends of the arms, and the spring plate is connected to one of the arms for turning movement therewith relative to the other arm. A detent ball supported in a socket on one arm and retained therein by engagement with the spring plate enters a detent dimple when the arms reach a limit of their relative turning movement.

10 Claims, 9 Drawing Figures

FIG. 1
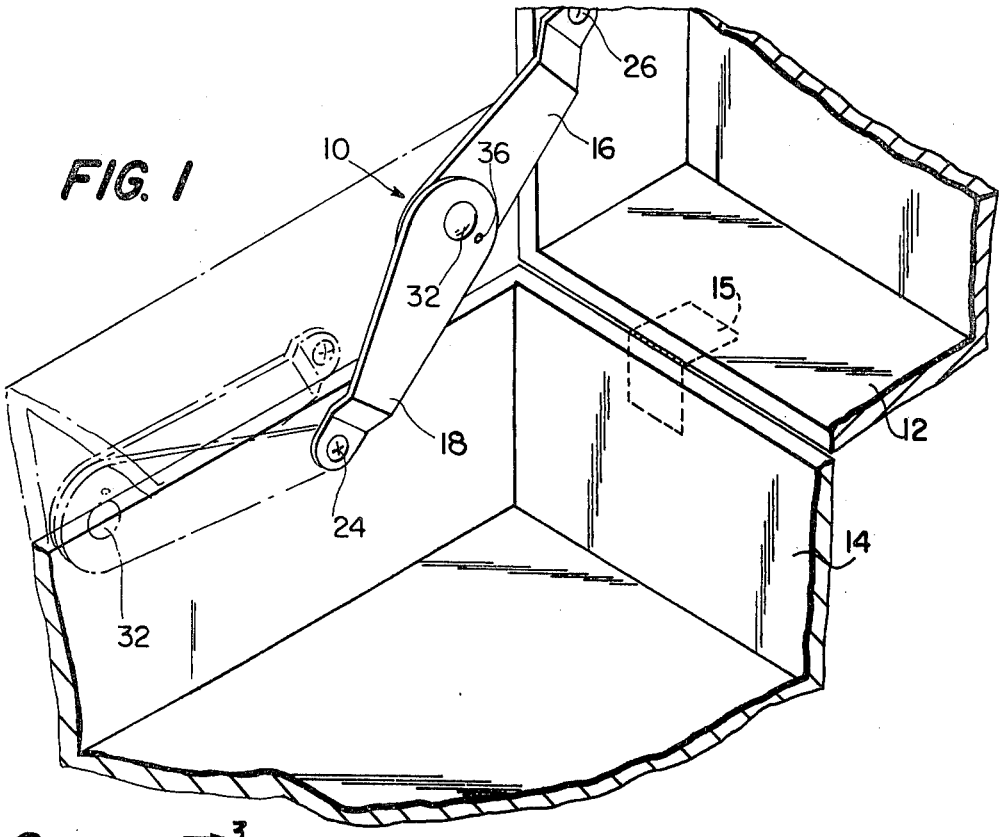
FIG. 2
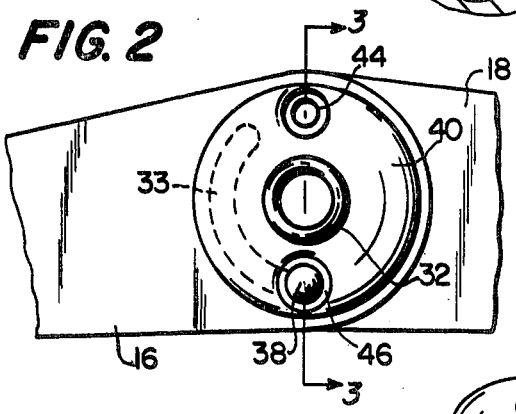
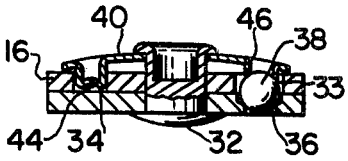
FIG. 3
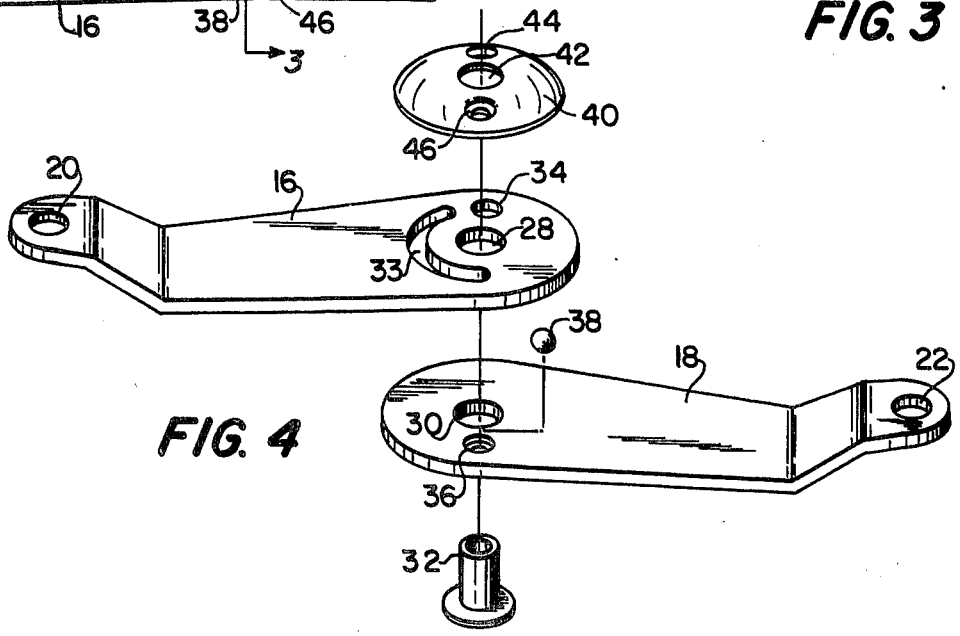
FIG. 4

FIG. 5
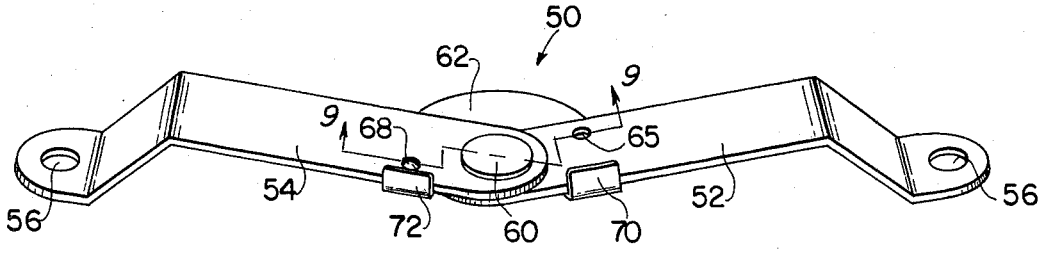
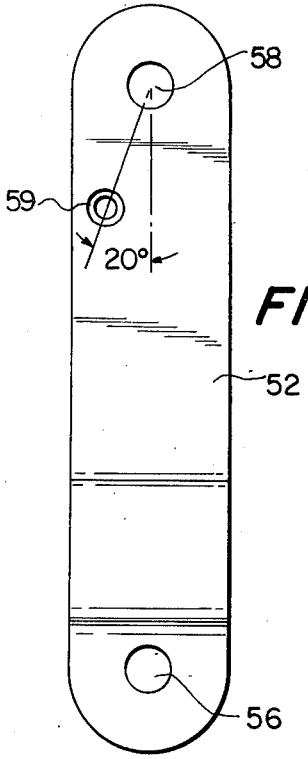
FIG. 6
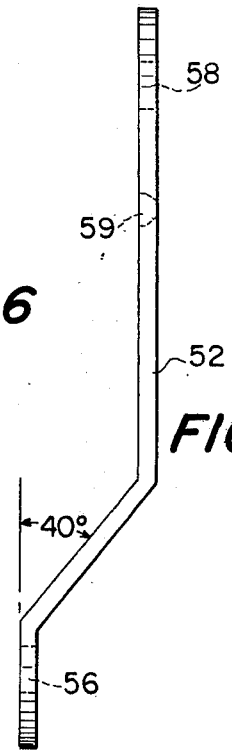
FIG. 7
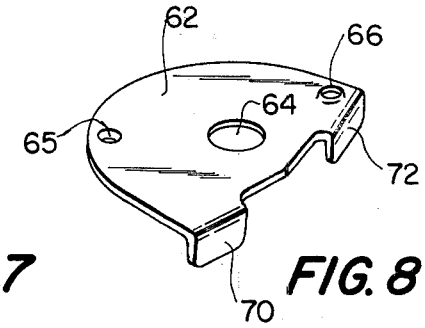
FIG. 8
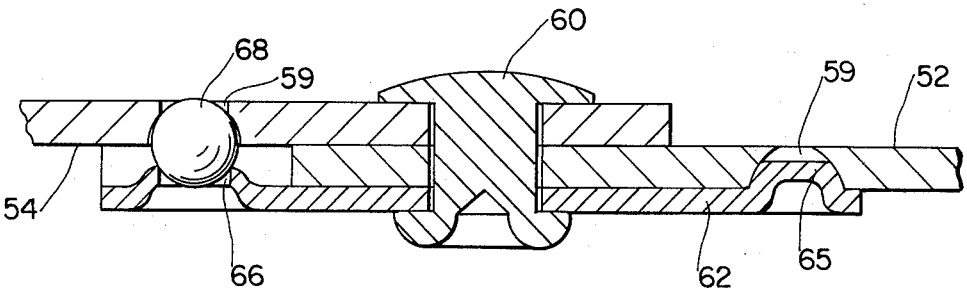
FIG. 9

STAY FOR HINGED MEMBERS

BACKGROUND OF THE INVENTION

This invention is concerned with a stay for hinged members and more particularly with a stay for retaining the open position of the cover of a suitcase or other receptacle having a hinged cover.

This invention is an improvement upon the stay or toggle brace of U.S. Pat. No. 1,779,281, granted Oct. 21, 1930 to A. Levine and assigned to the same assignee as the present invention. One advantage of the Levine stay is that the stay does not require manual "breaking" to permit the cover of a case to be closed when desired. Other stays of the prior art are disclosed, for example, in U.S. Pat. Nos. 103,181; 154,555; 766,917; 1,131,366; and 2,442,955.

Prior art stays, such as disclosed in the Levine patent, employ a pair of arms which turn relatively about a pivot pin from a collapsed position to an extended position at which the arms are releasably retained by a detent mechanism. Prior detent mechanisms employ a ball or dimple in rolling or sliding contact with one of the arms under heavy pressure, resulting in significant wear. Moreover, prior stays have had rather high manufacturing, tooling, and assembly costs.

BRIEF DESCRIPTION OF THE INVENTION

It is accordingly a principal object of the present invention to provide an improved stay for hinged members, as for example a stay which retains the open position of the cover of a suitcase or other receptacle having a hinged cover.

Another object of the invention is to provide a stay having minimal manufacturing, tooling, and assembly costs.

Still another object of the invention is to provide an attractive stay with increased lifetime, reduced wear, and superior performance.

Yet another object of the invention is to provide an improved stay in which the arms of the stay may be substantially identical.

Briefly stated, in one of its broader aspects a stay in accordance with the invention comprises a pair of arms each having one end adapted to be connected to a hinged member and each having another end with a hole therethrough, the other ends of the arms being overlapped with the holes aligned, a spring plate superposed with the overlapped ends of the arms and having a hold therethrough aligned with the holes through the arms, means including a pivot pin extending through the holes for joining the arms and the spring plate and for permitting the arms to turn relatively about the pivot pin, and means coupling the spring plate to one of the arms for turning movement therewith relative to the other arm, the other arm having a detent projection at its other end which turns with the other arm relative to the one arm, and the spring plate having a detent recess for receiving the projection when the arms are turned relatively to a predetermined position.

BRIEF DESCRIPTION OF THE DRAWINGS

The invention will be further described in conjunction with the accompanying drawings, which illustrate preferred and exemplary embodiments, and wherein:

FIG. 1 is a fragmentary perspective view illustrating a first embodiment of the invention applied to hinged members, such as the cover and body portion of a suitcase, for example;

FIG. 2 is a fragmentary elevation view illustrating overlapped ends of the stay and a superposed spring plate and showing the side of the stay that is hidden in FIG. 1;

FIG. 3 is a sectional view taken along line 3—3 of FIG. 2;

FIG. 4 is an exploded perspective view of the stay of FIG. 1;

FIG. 5 is a perspective view of a second embodiment of a stay in accordance with the invention;

FIG. 6 is a side elevation view of an arm of the stay of the second embodiment;

FIG. 7 is a further elevation view of the arm as seen edge-wise;

FIG. 8 is a perspective view of a spring plate employed in the second embodiment; and FIG. 9 is an enlarged sectional view taken approximately along lines 9—9 of FIG. 5.

DESCRIPTION OF THE PREFERRED EMBODIMENTS

Referring to the drawings, as shown in FIG. 1 a stay 10 in accordance with a first embodiment of the invention may be employed in conjunction with hinged members such as the cover 12 and body portion 14 of a suitcase or other receptacle. The cover 12 is supported upon the body portion 14 by conventional hinges 15, only one of which is shown. It is to be understood, however, that the invention is not limited to use with suitcases, luggage, or receptacles but may be employed wherever it is appropriate to control the relative positions of hinged members. The fully open position of the cover 12 relative to the body portion 14 is shown in full lines in FIG. 1, while the fully closed position is indicated in phantom lines.

In the first embodiment of the invention, shown in FIGS. 1–4, the stay 10 comprises a pair of arms 16 and 18, each having a hole 20, 22 at one end for receiving a rivet or other fastening element 24, 26 for pivotally mounting the arms on the hinged members. The arms may be somewhat tapered, as shown and are formed of a suitable material, such as cold rolled steel. The mounting end of each arm is preferably offset as shown, so that the major portions of the arms may be spaced from the walls of the hinged members to which the arms are attached.

The other end of each arm has a hole 28, 30 for receiving a pivot pin 32, such as a rivet, when the arms are overlapped and the holes 28 and 30 are aligned as shown in FIG. 4. Arm 16 has an arcuate slot 33 centered about the axis of hole 28 and has a further hole 34. Arm 18 has a socket hole 36 for receiving and supporting a detent projection, preferably a hardened steel ball 38, which protrudes into slot 33 and travels along the slot when the arms are turned relatively about pivot pin 32.

A spring plate 40 is superposed with the overlapped arms as shown. The spring plate is preferably a hardened spring steel disk bowed outwardly from the arms and having a central hole 42 through which the rivet 32 passes. The rivet, when expanded as shown in FIG. 3, assembles the arms 16 and 18 and the spring plate 40, with the spring plate compressed somewhat, and permits relative turning movement of the arms about the rivet.

Spring plate 40 has an integral projection 44 which is received within opening 34 of arm 16 to fix the spring plate to arm 16 for turning movement therewith. The spring plate is also formed with a detent dimple or recess 46 having a lip which protrudes into one end of slot 33 and which resiliently captures ball 38 when arms 16 and 18 are at one extremity of their relative turning movement. In the form shown, this occurs when the arms are almost fully extended away from each other as shown in FIG. 1, with the detent mechanism comprising ball 38 and spring recess 46 releasably holding the arms 16 and 18 in their extended position. Added detent recesses may be provided on the spring plate to capture ball 38 at other positions at which it may be desired to releasably maintain the arms and hinged members.

When closing pressure is applied to cover 12 in FIG. 1, arm 18 turns relative to arm 16, snapping the ball 38 out of the recess 46. The ball 38 then travels along slot 32 as the cover is closed and the arms turn relatively to a collapsed position, the ball being held in its socket 36 by engagement with the underside of spring plate 40. Movement of the ball along the hardened spring plate with just sufficient engagement of the ball and the spring plate to maintain the ball in its socket solves the problem of wear at the mutually engaged ball and spring plate surfaces.

When the arms of the stay are extended and the ball engages the lip of the detent recess 46, a force is exerted upon the spring plate to lift the plate and permit the ball to enter the recess, but this force is readily accommodated by the hardened spring plate without significant wear. Moreover, when the arms are extended as in FIG. 1, the offset of the mounting axis from the pivot axis (i.e., offset of a line between the centers of rivets 24, 26 and a parallel line through the center of rivet 32) is typically only of the order of 0.2 inch, so that only a small pressure must be exerted by the spring plate 40 on ball 38 for proper detent action, further reducing wear. This offset permits the stay to be collapsed to close cover 12 without manual release of the detent mechanism. Bowing of the spring plate 40 (which ma be on an arc of about 2.3 inches, for example) permits the spring plate to be compressed somewhat by rivet 32 as previously stated, reducing tolerances in closing the rivet and insuring that proper detent pressure is maintained throughout the life of the stay. The spring pressure also serves to regulate the friction between the arms, of course.

In a typical stay according to the embodiment of FIGS. 1–4, holes 20 and 28 are centered on the longitudinal axis of arm 16. Slot 33 extends from one end at an orthogonal transverse axis (on which hole 28 is located) about 135° to its other end, being lengthened a bit by the curved ends of the slots. Hole 34 is located about 7.5° beyond the transverse axis (away from slot 33). Hole 36 on arm 18 is located about 7.5° before a corresponding transverse axis of arm 18 on which hole 36 is located.

FIGS. 5–9 illustrate a second embodiment of the invention which, although not as preferable as the first embodiment, has an advantage in that the arms are substantially identical and interchangeable. As shown in FIG. 5, the stay 50 has a pair of arms 52 and 54, each of which has the same configuration, such as that shown in FIGS. 6 and 7 for arm 52. The arms may be formed of cold rolled steel, for example. As illustrated, each arm has a hole 56 at one end, this end preferably being offset as shown. Hole 56 receives a fastener for connecting the arm to a hinged member, as shown in FIG. 1 with respect to the first embodiment of the invention. The other end of the arm has a hole 58, which is aligned with the corresponding hole of the other arm to receive a pivot pin or rivet 60 when the arms are overlapped as shown in FIGS. 5 and 9. Adjacent to hole 58 each arm also has a recess 59, which may be a hole through the arm that is then swedged to hemi-spherical shape.

Spring plate 62 is formed with an integral projection 65 that is received in the recess 59 of one of the arms, such as arm 52, and has a detent recess 66 for receiving a projection, preferably a hardened steel ball 68, carried in the recess 59 of the other arm, 54 in this instance. Ball 68 engages the underside of spring plate 62 throughout most of the relative turning movement of the arms and enters the detent recess 66 when the arms reach one extremity of relative turning movement, which, in the form shown is the position at which the arms are almost fully extended away from each other. Added detent recesses may be provided on the spring plate 62 to capture ball 68 at other positions at which it is desired to maintain the arms releasably. In the second embodiment the spring plate 62 is provided wth tabs 70 and 72 which are bent out of the plane of plate 62 and which engage edges of the arms to limit the relative turning movement of the arms to an "open" position at which the arms form an included angle of 160°, for example. This permits a carrying case to be closed without requiring manual release of the detent mechanism. In normal operation only tab 72 is required, since arm 52 normally turns with spring plate 62, but tab 70 may be employed to provide a more positive limit stop. When the stay is collapsed, the offsetting (e.g., 20° in FIG. 6) of recesses 59 from the center line of the arms 52 and 54 (on which holes 56 and 58 are preferably located) permits the stay to "close" to a spacing between holes 56 of the respective arms of about 1 inch, for example, without interference between ball 68 and arm 52.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. A stay for hinged members comprising a pair of arms each having one end adapted to be connected to a hinged member and each having another end with a hole therethrough, said other ends of said arms being overlapped with said holes aligned, a spring plate superposed with said overlapped ends of said arms ad having a hole therethrough aligned with said holes through said arms, means including a pivot pin extending through said holes for joining said arms and said spring plate and for permitting said arms to turn relatively about said pivot pin, and means coupling said spring plate to one of said arms for turning movement therewith relative to the other arm, said other arm having a detent projection at its said other end which turns with said other arm relative to said one arm, and said spring plate having a detent recess for receiving said projection when said arms are turned relatively to a predetermined position.

2. A stay in accordance with claim 1, wherein the detent projection is a ball supported in a socket in said other arm.

3. A stay in accordance with claim 2, wherein said one arm has a slot arcuate about the pivot pin through which the ball projects and in which the ball moves as the arms are turned relatively.

4. A stay in accordance with claim 3, wherein the spring plate overlies the slot and the ball engages the spring plate throughout the relative turning movement of the arms and is held in its socket by the spring plate.

5. A stay in accordance with claim 4, wherein the detent recess has a lip protruding into the slot.

6. A stay in accordance with claim 1, wherein the spring plate is a disk bowed outwardly of the arms.

7. A stay in accordance with claim 1, wherein said coupling means comprises a further projection on the spring plate received in a hole in said one arm.

8. A stay in accordance with claim 1, wherein the spring plate has tab means engageable with said other arm for limiting the relative turning movement of the arms.

9. A stay in accordance with claim 1, wherein the arms are substantially identical.

10. A stay in accordance with claim 2, wherein the spring plate and the ball are of hardened steel.

* * * * *